US009250051B1

(12) United States Patent
Smith et al.

(10) Patent No.: US 9,250,051 B1
(45) Date of Patent: Feb. 2, 2016

(54) SQUIB INITIATION SEQUENCER

(75) Inventors: Gregory Harris Smith, Placentia, CA (US); Son T. Vo, Huntington Beach, CA (US); Randall Wayne Watkins, Chino Hills, CA (US); William L. Moon, LaHabra, CA (US)

(73) Assignee: The Boeing Company, Chicago, IL (US)

( * ) Notice: Subject to any disclaimer, the term of this patent is extended or adjusted under 35 U.S.C. 154(b) by 769 days.

(21) Appl. No.: 13/072,079

(22) Filed: Mar. 25, 2011

(51) Int. Cl.
*F23Q 7/00* (2006.01)
*F42D 1/05* (2006.01)

(52) U.S. Cl.
CPC ..... *F42D 1/05* (2013.01)

(58) Field of Classification Search
CPC ..... F42D 1/05
USPC ..... 361/249
See application file for complete search history.

(56) References Cited

U.S. PATENT DOCUMENTS

| | | | | |
|---|---|---|---|---|
| 3,559,582 | A * | 2/1971 | Hrzek | 102/217 |
| 3,757,696 | A * | 9/1973 | Derk | 102/217 |
| 5,517,920 | A * | 5/1996 | Hinz et al. | 102/215 |
| 6,267,326 | B1 | 7/2001 | Smith et al. | |
| 6,300,764 | B1 * | 10/2001 | Kelley | 324/502 |
| 2008/0086250 | A1 * | 4/2008 | Kuivenhoven | 701/45 |
| 2009/0085612 | A1 | 4/2009 | Smith et al. | |

* cited by examiner

*Primary Examiner* — Stephen W Jackson
*Assistant Examiner* — Ann Hoang
(74) *Attorney, Agent, or Firm* — Patterson & Sheridan, LLP

(57) ABSTRACT

Technologies for sequentially initiating squibs in one or more release mechanisms in order to reduce delay between successive squibs are provided. A squib initiation sequencer is configured to initiate squibs of one or more release mechanisms in a pre-programmed sequence. The squib initiation sequencer is further configured to detect when the initiation of each squib in the sequence is complete, and immediately move to the next sequential step without waiting the entire maximum initiation time per the squib manufacturer's specifications.

19 Claims, 8 Drawing Sheets

SQUIB INITIATION SEQUENCER

GOVERNMENT RIGHTS

This invention was made with Government support under Contract No. H00276-08-C-0001 awarded by the Department of Defense. The Government has certain rights in this invention.

BACKGROUND

A rocket, missile, or other launch vehicle may consist of a number of stages, each of which contains its own engines and propellant and which may be fired successively at different phases of flight. Once a stage has expended its propellant, the stage may be jettisoned from the launch vehicle, thus reducing the mass of the remaining rocket. Similarly, once the last stage of the launch vehicle has been expended, the attached payload, such as a satellite, spacecraft, kill-vehicle, or warhead, may be separated from the upper stage in order to complete its tasks.

The various stages and payload of the rocket or missile may be attached to one another by one or more release mechanisms, such as explosive bolts or other pyrotechnic fasteners. These pyrotechnic fasteners may contain an explosive charge activated by a "squib" that when initiated, breaks the fastener mechanism into multiple pieces, thus releasing the attached components. The squib may be initiated, or "fired," by applying an electric current to a bridgewire, bridge resistor, or other pyrotechnic initiator in the squib. For example, in order to deploy the payload at the end of the boost phase of flight, the launch vehicle's guidance computer or other flight control system may energize the bridgewires of the squibs in the release mechanisms securing the payload to the upper stage.

It may not be desirable to fire all the release mechanisms attaching the payload to the upper stage at the same time. For example, firing all the release mechanisms simultaneously may produce too much shock to the payload. In addition, the power systems of the launch vehicle may not be able to generate enough power to simultaneously initiate all the squibs for the release mechanisms. For example, a kill-vehicle on an anti-missile rocket may be secured to an ejector platform of the upper stage of the rocket by four separation nuts. Each of the separation nuts may contain two squibs, a primary and a redundant, requiring 3.5 amps of current be applied for 25 milliseconds to guarantee firing, according to manufacturer's specifications. Ensuring that all four separation nuts fire simultaneously may require up to 28 amps of current be applied to the squibs for 25 milliseconds, which may be beyond the power capabilities of the rocket.

It is with respect to these and other considerations that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Methods, apparatus, and systems described herein provide for sequentially initiating squibs in one or more release mechanisms in order to reduce power requirements and unnecessary delay between successive squibs. According to aspects presented herein, a method for sequentially initiating squibs includes firing a first squib or set of squibs in a sequence by passing a current through the squibs and then monitoring the current flow through the squibs. When the current flow through the first set of squibs falls below a minimum threshold amount, indicating that firing of the squibs is complete, the squib initiation sequencer immediately proceeds to fire a second squib or set of squibs in the sequence.

According to further aspects presented herein, a squib initiation sequencer includes a logic module configured to fire a number of squibs in a pre-programmed sequence. The logic module is connected to a firing circuit for each of the squibs, and each firing circuit includes a firing monitor configured to determine that firing of the connected squib has been completed and to signal the logic module to immediately proceed to a next squib in the pre-programmed sequence. In yet another aspect, a system for separating two removably attached components includes a number of release mechanisms attaching the components and a squib initiation sequencer electrically connected to each of the release mechanisms and configured to fire squibs in the release mechanisms in a pre-programmed sequence. The squib initiation sequencer is further configured to, upon determining that a firing of a first squib in the pre-programmed sequence is complete, immediately proceed to fire a next squib in the pre-programmed sequence.

The features, functions, and advantages discussed herein can be achieved independently in various embodiments of the present disclosure or may be combined in yet other embodiments, further details of which can be seen with reference to the following description and drawings.

DETAILED DESCRIPTION

Figure 1:
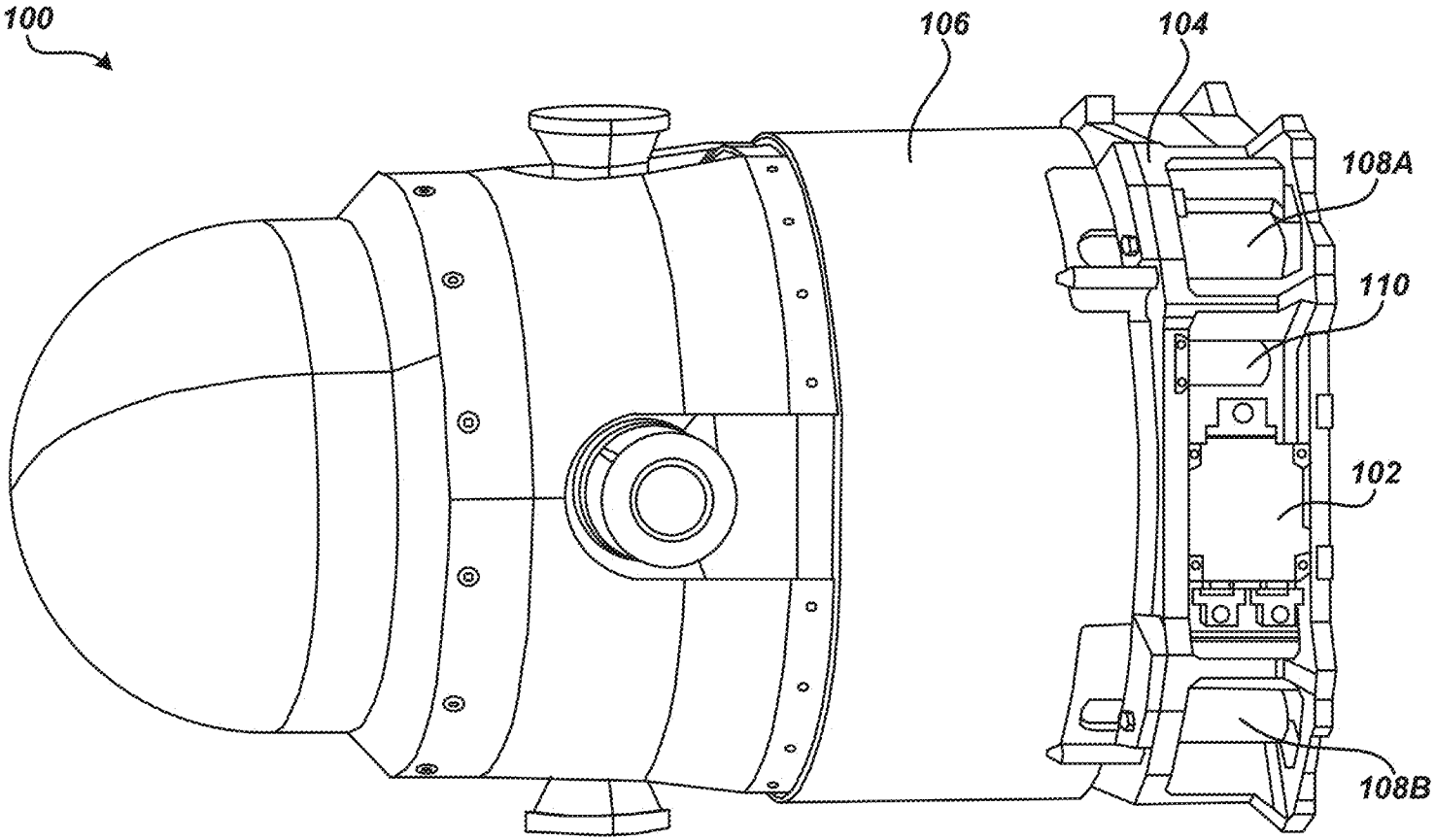
FIG. 1 is a perspective view of an exemplary payload and ejector platform attached by release mechanisms along with a squib initiation sequencer, according to embodiments presented herein.

The following detailed description is directed to apparatus, systems, and methods for sequentially initiating squibs in one or more release mechanisms in order to reduce power requirements and unnecessary delay between successive firing of squibs. Utilizing the concepts and technologies described herein, an intelligent squib initiation sequencer in a rocket or launch vehicle may initiate squibs of one or more release mechanisms in a sequential pattern during payload deployment, staging, or other separation or release sequences. Initiating multiple squibs sequentially instead of all at once or in some combination reduces the total current required for each step of the sequence, thus avoiding overloading the power capabilities of the system. In addition, the squib initiation sequencer has the ability to detect when each squib in the sequence has fired, and immediately move to the next sequential step without waiting for the entire maximum initiation time according to the manufacturer's specifications for the squibs. This allows the squib initiation sequencer to avoid unnecessary delay between the initiation of successive squibs, thus allowing for better control of payload release, minimized payload tip-off rates, faster payload attitude control, and better overall flight performance.

As described herein, release mechanisms include pyrotechnic and non-pyrotechnic devices, such as explosive bolts, ball locks, separation nuts ("sepnuts"), gas generators, non-explosive actuators ("NEAs") and the like. Non-pyrotechnic release mechanisms may be initiated electrically without the use of explosive charges. For example, initiation may occur through the use of a link wire which electrically fuses by applying an electric current to start a mechanical chain of actions leading to release of the mechanism. As used herein, the term "squib" includes these non-explosive link wires as well as any other actuating means of a release mechanism.

While the squib initiation sequencer disclosed herein is presented in the context of initiating squibs in release mechanisms or separation devices in a rocket system for payload deployment, it will be appreciated that the technologies and methods described herein may be utilized to sequentially initiate release mechanisms or pyrotechnics in other types of operations and systems as well, including multi-stage launch vehicles, ordnance drivers in weapon systems, driver for solar panel deployment, munition dispenser tube technologies, staged parachute deceleration systems, aircraft ejection seats, braking systems, and any other system for releasing latches or controlling other electrical-chemical-mechanical systems that require sequential activation.

In the following detailed description, references are made to the accompanying drawings that form a part hereof, and that show, by way of illustration, specific embodiments or examples. The drawings herein are not drawn to scale. Like numerals represent like elements throughout the several figures.

FIG. 1 shows an exemplary operating environment 100 for the squib initiation sequencer 102, according to one embodiment. The squib initiation sequencer 102 may be mounted on an ejector platform 104 that is mounted to an upper-most stage of a launch vehicle, for example. The ejector platform 104 may further be removably attached to a payload 106, such as a satellite, a spacecraft, a kill-vehicle, a warhead, and the like. According to embodiments, the payload 106 is attached to the ejector platform 104 by one or more release mechanisms 108A, 108B (referred to herein generally as release mechanism 108), such as explosive bolts, separation nuts, ball-locks, or any other release mechanisms known in the art. For example, a payload 106 consisting of a kill-vehicle may be attached to the ejector platform 104 on the upper stage of a rocket using four separation nuts, two of which are illustrated at 108A and 108B in FIG. 1.

Each release mechanism 108 is electrically connected to the squib initiation sequencer 102 such that the sequencer may initiate a squib or other explosive charge in each release mechanism, thus detaching the payload 106 from the ejector platform 104. According to embodiments, upon receiving an instruction to deploy the payload 106, the squib initiation sequencer 102 applies a current or sends an electrical signal supplied from a battery 110 or other power supply to the squibs in the release mechanisms 108 in a pre-programmed sequence in order to fire the explosive charge and separate the payload 106 from the ejector platform 104. For example, the squib initiation sequencer 102 shown illustrated in FIG. 1 may first fire two of the four separation nuts located diagonally opposite of each other, and subsequently fire the remaining two separation nuts in order to deploy the kill-vehicle from the ejector platform 104.

Firing the release mechanisms 108 in this sequential two and two pattern may reduce the shock to the payload 106 upon separation. According to one embodiment, the squib initiation sequencer 102 is also able to detect the successful firing of the first two release mechanisms 108 and immediately fire the remaining two fasteners, as will be described in more detail below in regard to FIGS. 3 and 4. This reduces unnecessary delays between the sequential firings, thus reducing tip-off rates in the payload 106 upon deployment and allowing the flight control system of the payload to attain attitude control more quickly. In addition, the sequential firing and reduced delay may require less power from the battery 110 or other power supply of the launch vehicle, because the battery must only supply current for two release mechanisms 108 at once and only for a limited amount of time.

Figure 2:
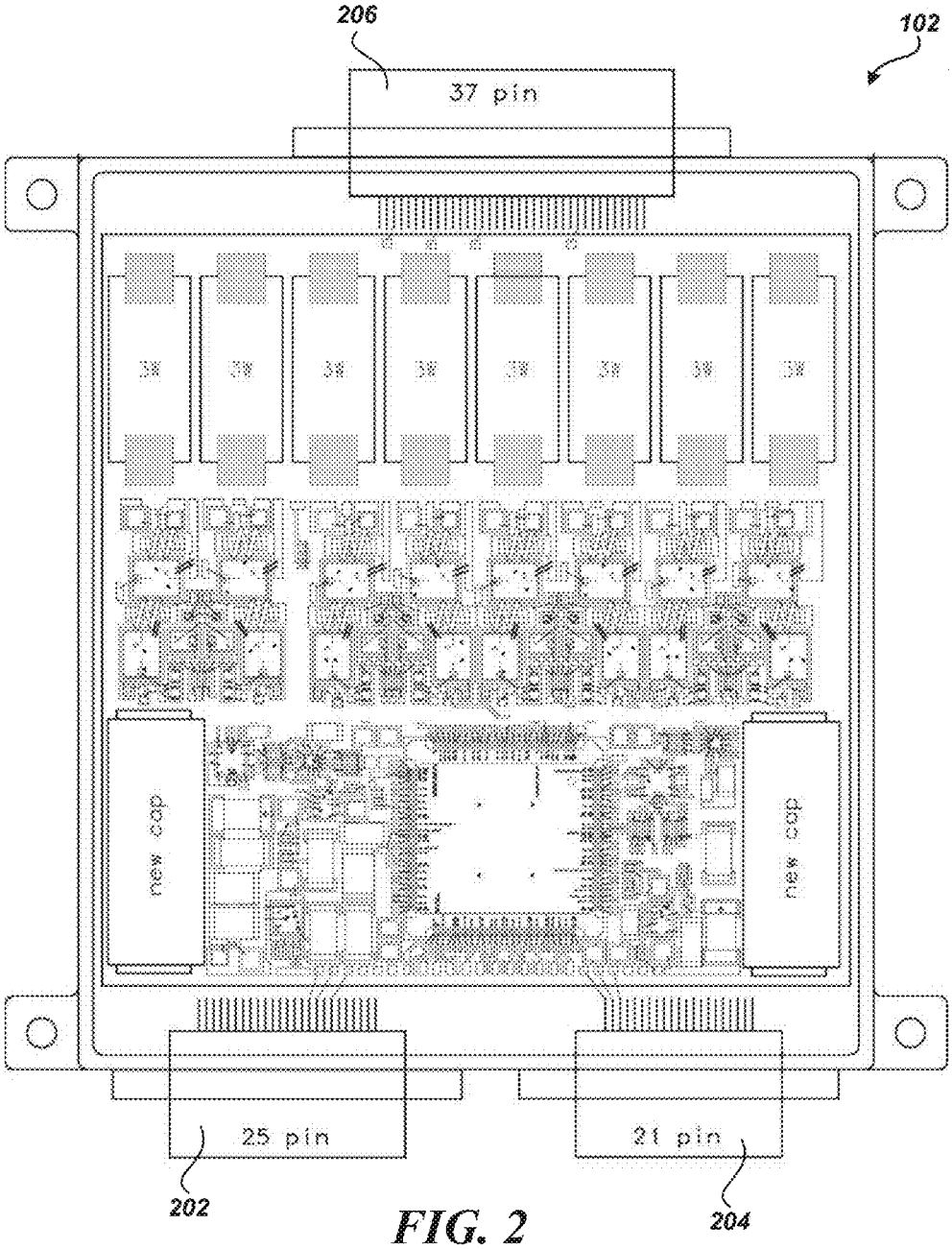
FIG. 2 is a plan view of an exemplary squib initiation sequencer module, according to embodiments presented herein.

In one embodiment, the squib initiation sequencer 102 is implemented as a single module comprising a multi-chip module ("MCM") or hybrid integrated circuit ("HIC") housed in a Kovar or other lightweight and rigid encasement, as shown in FIG. 2. This removes the need for a printed circuit board and allows the squib initiation sequencer 102 to be small and lightweight, and thus installed in a small space on the ejector platform 104 or other component of the launch vehicle. For example, the squib initiation sequencer 102 may measure as small as 4.0" wide, 3.2" deep, and 0.6" high when assembled with the encasement, MCM, and cover, according to one embodiment. Implementing the squib initiation sequencer 102 as an MCM or HIC may also allow the squib initiation sequencer 102 to better withstand the rigors of rocket-propelled flight.

Figure 3:
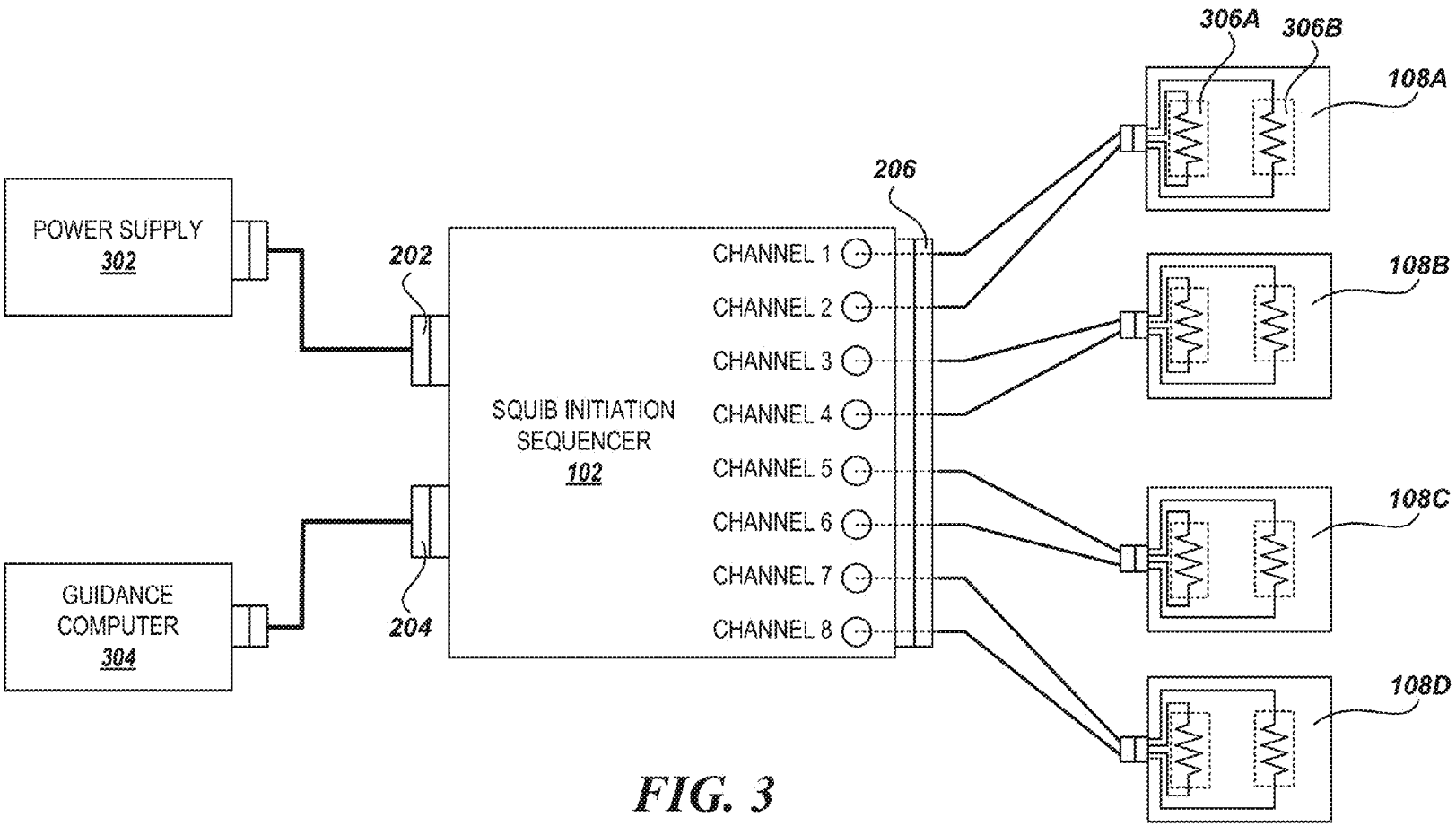
FIG. 3 is a block diagram showing connections between the squib initiation sequencer and other components of the payload and/or ejector platform, according to embodiments presented herein.

The squib initiation sequencer 102 may also contain a minimum number of external connectors to reduce size and installation complexity. For example, as further shown in FIG. 2, the squib initiation sequencer 102 comprises three external connectors: a power connector 202, a signal connector 204, and an output connector 206, according to one embodiment. As shown in FIG. 3, the power connector 202 may electrically-connect the squib initiation sequencer 102 to a power supply 302. The power supply 302 may be a main power supply of the launch vehicle or the payload 106, or the power supply 302 may be a supplemental power source for the ejector platform 104, such as a battery 110 attached to the platform, as shown in FIG. 1. According to one embodiment, the power supply 302 provides an input voltage of 23 to 35 VDC to the squib initiation sequencer 102 and remains on during the entire payload deployment operation.

The signal connector 204 may electrically-connect the squib initiation sequencer 102 to a guidance computer 304 or flight control system of the launch vehicle and/or payload 106. The guidance computer 304 provides input signals to the squib initiation sequencer 102 for operation of the sequencer in conjunction with other flight systems and components. For example, the guidance computer may supply a timing signal, such as a 10 MHz clock, to the squib initiation sequencer 102 for synchronized operation of the sequencer with other launch vehicle and/or payload systems. The guidance computer 304 may further provide an initiation signal to the squib initiation sequencer 102 in order to activate a squib initiation sequence to fire the release mechanisms and deploy the payload 106, as is described in more detail below in regard to FIG. 4.

In one embodiment, the initiation signal is transmitted to the squib initiation sequencer 102 utilizing a standard protocol, such as RS-422 signaling, over a balanced or differential communication channel provided through the signal connector 204. Alternatively, the communication channel provided to the squib initiation sequencer 102 through the signal connector 204 may be any serial or parallel communication path known in the art. As will be described in more detail below, the initiation signal may comprise a single binary command that is issued to the squib initiation sequencer 102 by the guidance computer 304 when the squib initiation sequence is to begin, or the input signal may comprise a more complex series of commands to drive various activities of the squib initiation sequencer 102. The squib initiation sequencer 102 may further provide telemetry regarding the squib initiation sequence back to guidance computer 304 via the same or similar communication channel through the signal connector 204.

The output connector 206 of the squib initiation sequencer 102 electrically-connects the sequencer to one or more squibs 306A-306B (referred to herein generally as squib 306) or other explosive charges in the release mechanisms 108A-108D. In one embodiment, the squib initiation sequencer 102 supports eight separate channels for squib initiation. Each channel allows the squib initiation sequencer 102 to fire one or more squibs 306, with the sequencer energizing the channels in the pre-programmed squib initiation sequence. It will be appreciated that the squib initiation sequencer 102 may be implemented with any number of separate channels, depending on the number of release mechanisms 108 and other requirements of the launch system.

Each channel is electrically connected to a bridgewire, bridge resistor, linkwire, or other actuation means of the squib 306 to allow the squib initiation sequencer 102 to supply the required current to fire the squib. In one embodiment, the squib initiation sequencer 102 supplies a signal independently to each channel through the output connector 206 to improve reliability and safety in the system. In another embodiment, each of the release mechanisms 108A-108D may contain a primary squib 306A and a redundant squib 306B that provide the squib initiation sequencer 102 with two, independent means of firing the release mechanisms 108A-108D, thus increasing reliability of payload deployment. The squib initiation sequencer 102 may connect to the primary squib 306A and the redundant squib 306B of a particular release mechanism 108A through separate channels, allowing the primary and redundant squibs to be fired at two different points in the squib initiation sequence, or at the same time, depending on the requirements of the payload deployment and the pre-programmed sequence, as will be described below in regard to FIGS. 7A and 7B.

Figure 4:
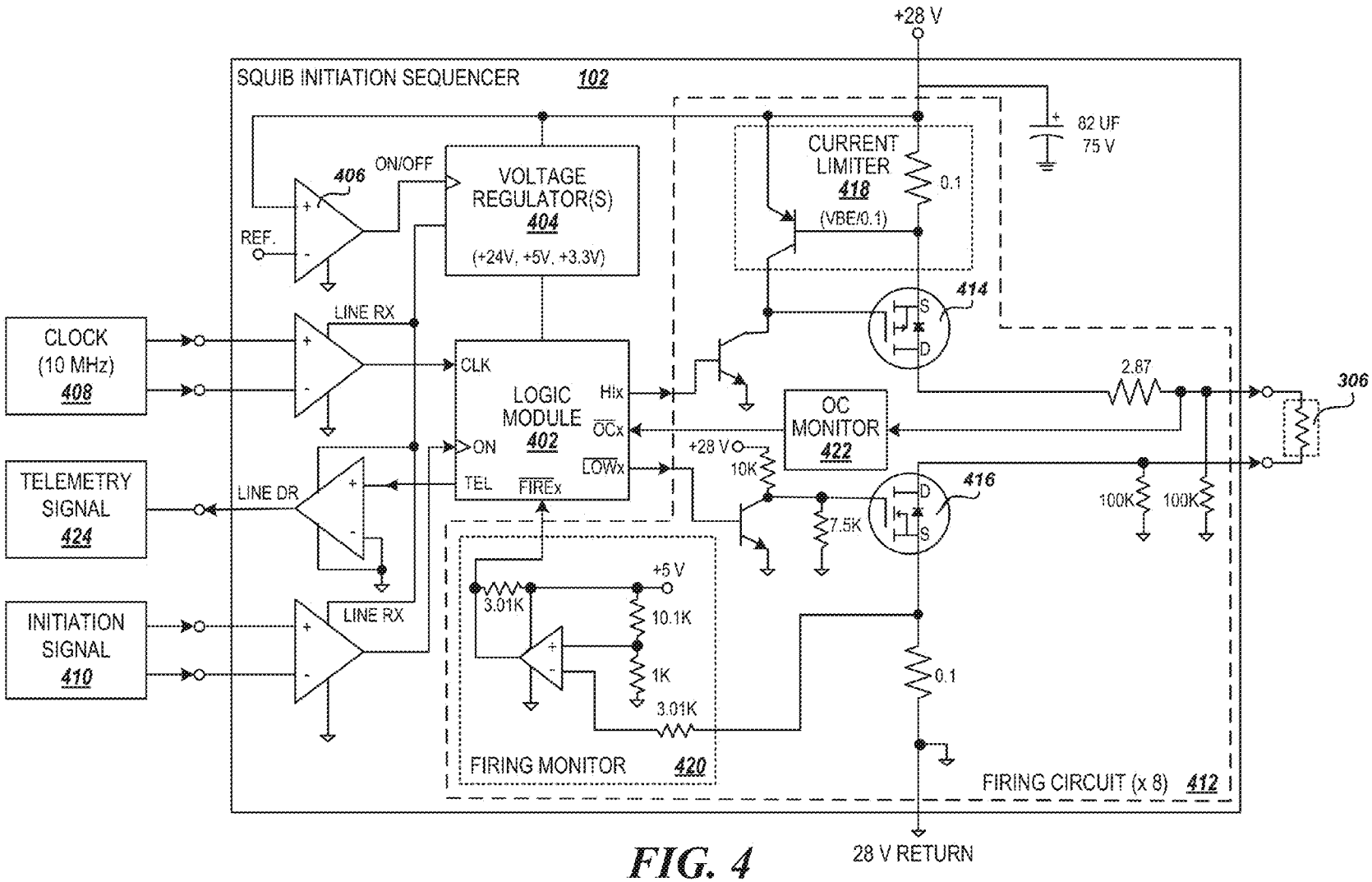
FIG. 4 is a block diagram showing functional components and exemplary circuitry of the squib initiation sequencer, according to embodiments described herein.

FIG. 4 provides further details regarding the components of the squib initiation sequencer 102, according to one embodiment. As may be seen in FIG. 4, the squib initiation sequencer 102 includes a logic module 402 that controls the squib initiation sequence. The logic module 402 may be implemented using an application-specific integrated circuit ("ASIC"), such as a field-programmable gate array ("FPGA"), a generic programmable logic device ("PLD"), such as a programmable array logic ("PAL") chip, or any other processor module or component known in the art. The logic module 402 may further include a memory (not shown) containing instructions for executing one or more pre-programmed squib initiation sequences as well as other operations of the squib initiation sequencer 102. The memory may be implemented in read-only memory ("ROM"), programmable ROM ("PROM"), electronically-erasable PROM ("EEPROM"), Flash memory, or the like.

The logic module 402 may receive power from the power supply 302 through one or more voltage regulator(s) 404 included in the squib initiation sequencer 102. The voltage regulator(s) 404 takes the voltage supplied by the power supply 302 through the power connector 202 and provides regulated voltage at various levels for the circuitry and components of the squib initiation sequencer 102. According to one embodiment, the squib initiation sequencer 102 further includes an activation comparator 406 that will not allow the logic module 402 and other circuits of the sequencer to activate unless the voltage supplied by the power supply 302 meets or exceeds a minimum threshold voltage required for the operation of the squib initiation sequencer 102.

The logic module 402 may receive the clock signal 408 from the guidance computer 304 in order to synchronize operations with other components and systems of the launch vehicle and/or payload 106. Similarly, the logic module 402 may further receive the initiation signal 410 generated by the guidance computer 304 or other flight control system and utilized to activate the pre-programmed squib initiation sequence. As described above, the initiation signal 410 may be a simple binary command that signals the logic module 402 to begin the pre-programmed squib initiation sequence. Alternatively, the initiation signal 410 may be a more complex command comprising a series of command bits or bytes that instructs the logic module 402 to begin a specified squib initiation sequence from among a number of pre-programmed squib initiation sequences stored in the memory, to immediately fire the squibs connected to a specified channel, to shut off current to all squibs, to fire all squibs simultaneously, or to take other directed action that may be requested by the guidance computer.

Figure 5:
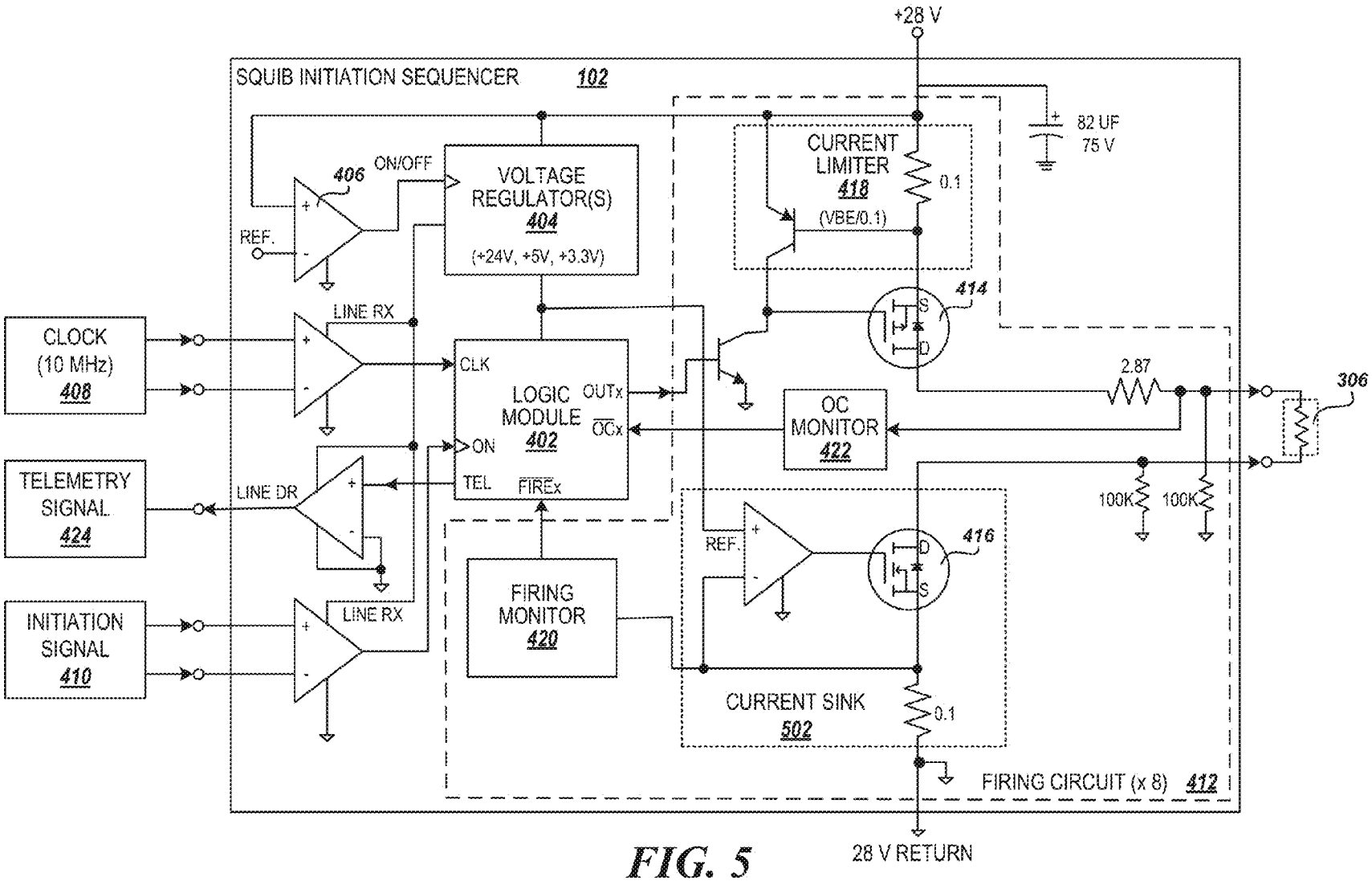
FIG. 5 is a block diagram showing another exemplary circuitry for the squib initiation sequencer, according to embodiments described herein.

The logic module 402 is electrically connected to a number of firing circuits 412. The number of firing circuits 412 may correspond to the number of channels implemented in the squib initiation sequencer 102. According to one embodiment, the logic module 402 provides a HI signal and a complementary $\overline{\text{LOW}}$ signal to each firing circuit 412. The HI signal drives a high-side field-effect transistor ("FET") 414, such as p-channel metal-oxide semiconductor FET ("MOSFET"), or other switching device while the complementary $\overline{\text{LOW}}$ signal drives a low-side FET 416, such as an n-channel MOSFET. The high-side FET 414 and low-side FET control the flow of current to the squib 306 attached to the channel of the squib initiation sequencer 102 corresponding to the firing circuit 412, as shown in FIG. 4. Having HI and complementary $\overline{\text{LOW}}$ signals to drive the current to the squib 306 may prevent unintentional firing of the squib upon failure of the logic module 402 that might result in driving all outputs high, for example. In another embodiment, the logic module may provide a single OUT signal to the firing circuit 412, as shown in FIG. 5.

According to embodiments, the logic module 402 can detect when the squib 306 connected to a channel of the squib initiation sequencer 102 has fired and immediately move to the initiate the squibs on the next channel(s) in the squib initiation sequence, as will be described in more detail below in regard to FIGS. 6-7B. This may be accomplished through a firing monitor 420 in each firing circuit 412. When the squib 306 connected to the channel corresponding to the firing circuit 412 is initiated, the firing monitor 420 detects current flowing through the bridgewire or bridge resistor of the squib 306 and sends a logical 0 signal to the logic module 402 indicating that current is flowing. Once the squib 306 has been fired, the bridgewire or other resistive element opens up, and the current stops flowing. Upon the cessation of current, the firing monitor 420 sends a logical 1 signal to the logic module 402 indicating firing of the squib is complete. It will be appreciated that some current may continue to flow through the squib 306 even after the squib has been initiated. According to one embodiment, the firing monitor 420 sends a logical 1 signal to the logic module 402 when the current detected flowing through the squib drops below a minimum threshold amount.

In another embodiment, each firing circuit 412 further includes a current limiter 418. The current limiter 418 limits the amount of current that the firing circuit 412 and squib 306 may draw when activated, to protect the power supply 302 in the event of a short at the high-side of the squib 306, for example. According to a further embodiment, each firing circuit also contains an over-current monitor 422 circuit. The over-current monitor 422 may detect an excessive amount of current through the connected squib 306, resulting from a short in the squib or at the high-side of the squib to ground, for example. Upon detecting the excessive amount of current in the squib 306, the over-current monitor 422 may signal the logic module 402 to immediately stop the current flowing to the squib in order to further protect the firing circuit 412 and connected power supply 302. The over-current monitor 422 may be implemented in a similar fashion to the firing monitor 420 described above, according to one embodiment.

In another embodiment, the logic module 402 provides a telemetry signal 424 to the guidance computer 304 or other system of the launch vehicle or payload 106. The telemetry signal 424 may be sent through a communication path provided between the squib initiation sequencer 102 and the guidance computer 304 through the signal connector 204, for example. The telemetry signal 424 may be a simple binary signal indicating a status of the squib initiation sequencer 102, such as the squib 306 or squibs connected to a current channel are being fired or firing of the squibs is complete, as detected by the firing monitor 420 of the corresponding firing circuit 412. Alternatively, the telemetry signal 424 may include a more complex message comprising a series of bits or bytes that indicate which channel(s) have been fired, the length of time the squibs connected to the channel were energized, over-current or other error conditions that have occurred, the overall health of the squib initiation sequencer 102, and the like.

In another embodiment, a constant current sink 502 circuit may be implemented to limit the current from the power supply 302, as shown in FIG. 5. In some applications, such as when a battery 110 is used as a power source, a maximum battery current may be specified. Since the squib load may be fixed at approximately 1 ohm, as the battery voltage increases, the input current likewise increases. To ensure that the input current from the battery 110 does not exceed its maximum specified level, the low-side circuitry of the firing circuit may be replaced with the current sink 502 to limit the battery current or changes in the input battery voltage. In this implementation, if the battery voltage in increased, instead of driving more current into the squib, the current sink 502 maintains the designed-to level by dropping the increased voltage and power across the low-side FET. This FET may thermally absorb and dissipate the increased power pulse. This allows input current to be limited to a fixed level over input voltage variations to reduce input power. For example, if the input voltage of +25 VDC allows +5 Amps of current to flow, and the input voltage is increased to +35 VDC, the current sink 502 will limit the current through the firing circuit to 5 amps, instead of 8 amps, and further drop the additional 10 volts from the input battery 110 across the low-side FET.

It will be appreciated that the components and circuitry shown in FIGS. 4 and 5 represent exemplary implementations of the squib initiation sequencer 102, and that other implementations will become apparent to one skilled in the art upon a reading this disclosure. It is intended that this application include all such implementations of the squib initiation sequencer 102. In addition, the values and specifications of the various, individual components shown in FIGS. 4 and 5 and described herein are for illustrative purposes only, and various components may be added, removed, or substituted in the implementation of the squib initiation sequencer 102 without departing from the scope and spirit of the present description.

Figure 6:
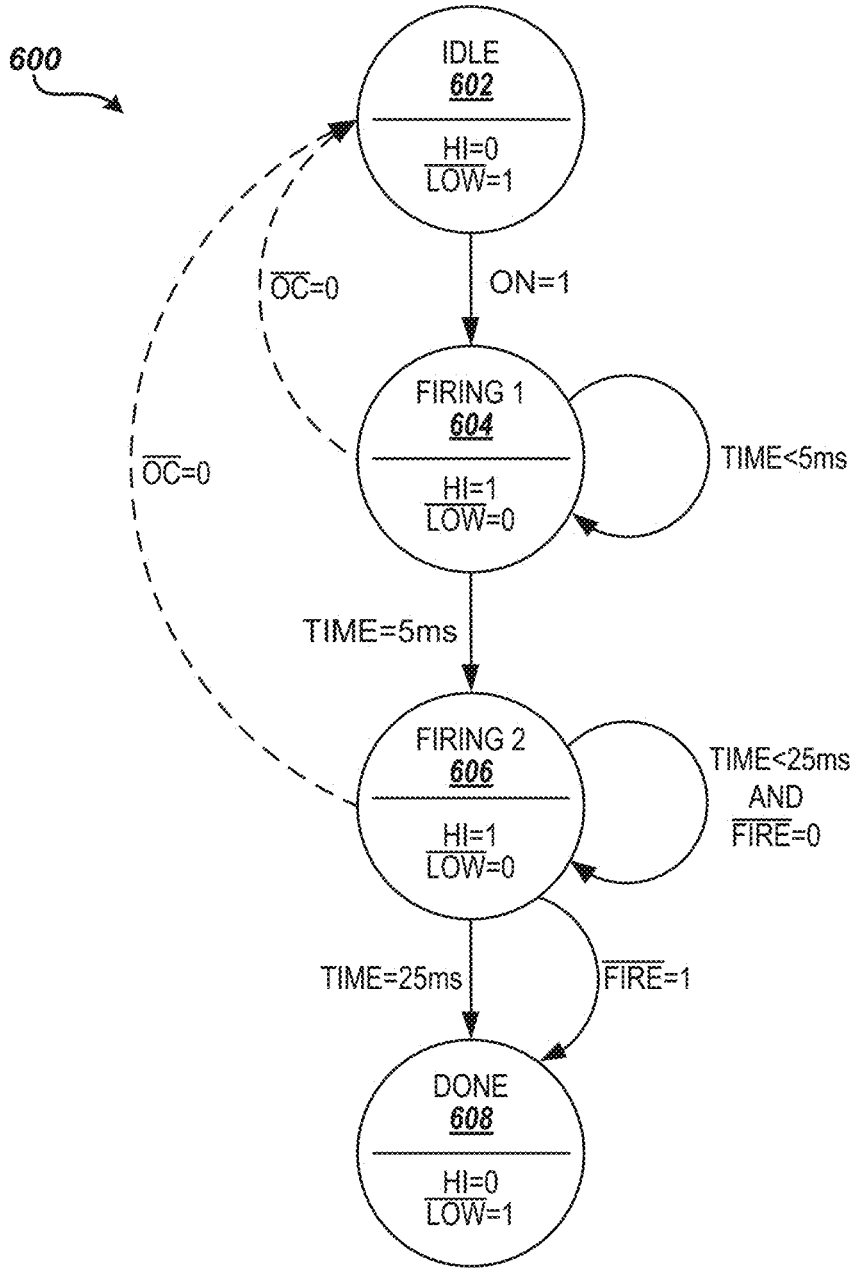
FIG. 6 is a state diagram showing an exemplary transition of states in a logic module of the squib initiation sequencer, according to embodiments presented herein.

FIG. 6 shows a state diagram 600 illustrating a behavior of the logic module 402 during the firing of the squib(s) 306 connected to a particular channel of the squib initiation sequencer 102. It should be appreciated that more or fewer states and state transitions may occur than shown in FIG. 3 and described below, and that the states and state transitions may occur in a different order or based on different conditions than those described herein. The logic module 402 begins in the idle state 602 with respect to the firing circuit 412 corresponding to the particular channel of the squib initiation sequencer 102. In the idle state 602, the logic module 402 provides a logical 0 on the HI signal and a logical 1 on the complementary $\overline{\text{LOW}}$signal to the firing circuit 412 in order to switch off the high-side FET 414 and the low-side FET 416 and prevent current flow to the connected squib 306.

While in the idle state 602, the logic module 402 may receive an indication that the squib 306 connected to the channel is to be fired, represented by the ON=1 condition in FIG. 6. If the channel to be fired is the first channel specified in the squib initiation sequence, the ON=1 condition may represent receiving the initiation signal 410 from the guidance computer 304 or other flight control system of the launch vehicle or payload 106, for example. The ON=1 condition may also represent the logic module 402 detecting that the squib 306 connected to a previous channel in the squib initiation sequence has fired.

Upon the ON=1 condition occurring, the logic module 402 transitions to the first firing state 604. In the first firing state 604, the logic module 402 provides a logical 1 on the HI signal and a logical 0 on the complementary $\overline{\text{LOW}}$ signal in order to initiate current flow through the corresponding firing circuit 412 and fire the connected squib 306. According to one embodiment, the logic module 402 remains in the first firing state 604 for a minimum firing time. The minimum firing time may be set based on the minimum, average, or typical firing time for the connected squib 306 based on the manufacturer's specifications for the squib or determined through experimentation. The minimum firing time may also be set to avoid excessive shock to the payload 106 from successive firing of squibs 306 in consecutive steps in the squib initiation sequence. In one embodiment, the minimum firing time may be 5 milliseconds. It will be appreciated that the minimum firing time may be any value between 0 milliseconds and the maximum firing time described below.

Upon the expiration of the minimum firing time, the logic module 402 transitions to the second firing state 606. In the second firing state 606, the logic module 402 keeps the logical 1 on the HI signal and the logical 0 on the complementary $\overline{\text{LOW}}$signal in order to continue current flow in the corresponding firing circuit 412 to the squib 306. According to embodiments, the logic module 402 will remain in the second firing state 606 until the logic module detects that firing of the squib 306 is complete. In one embodiment, the logic module 402 receives a logical 1 signal from the firing monitor 420, represented by the FIRE=1 condition in FIG. 6, implying that current has stopped flowing through the bridgewire or other resistive element in the squib 306 that results from the detonation of the explosive charge in the squib.

In addition, the logic module 402 may only remain in the second firing state 606 for a maximum firing time, even if completion of the firing of the squib 306 is not detected. The maximum firing time may be the recommended firing time required to ensure squib initiation, according to the manufacturer's specifications for the squib 306, for example. In one embodiment, the maximum firing time is 25 milliseconds. It will be appreciated that the maximum firing time may be any value between the minimum firing time and some maximum acceptable time between initiation of steps in the squib initiation sequence, as determined by the requirements of payload deployment or staging of the launch vehicle.

Upon detecting the firing of the squib 306 is complete, i.e. $\overline{\text{FIRE}}$=1, or the expiration of the maximum firing time, the logic module 402 transitions to the done state 608 in regard to the channel being fired. In the done state 608, the logic module 402 resets the HI signal of the firing circuit 412 to a logical 0 and the complementary $\overline{\text{LOW}}$ signal of the firing circuit 412 to a logical 1 in order to switch-off current flow to the connected squib 306. From the done state 608, the logic module 402 may immediately move to firing of the squib(s) 306 connected to the next channel specified in the squib initiation sequence. In one embodiment, the squib initiation sequencer 102 may initiate the squibs 306 connected to multiple, distinct channels in the same step of the squib initiation sequence. In these cases, the logic module may wait until the done state 608 is reached in regard to all channels in the step before proceeding to fire the squibs 306 connected to the next channel or channels specified in the squib initiation sequence.

It will be further appreciated that by being able to detect the completed firing of the squib 306 through the firing monitor 420, the logic module 402 can immediately move to the next set of squibs in the squib initiation sequence without waiting the maximum firing time, such as 25 milliseconds, as specified by the manufacturer of the squib to ensure squib initiation. This may save power in the system as well as eliminate unnecessary delays between squib firings, reducing tip-off rates and improving payload deployment. Furthermore, this may result in faster payload attitude control and reduce potential risk of payload re-contact with its launch vehicle.

Figure 7A:
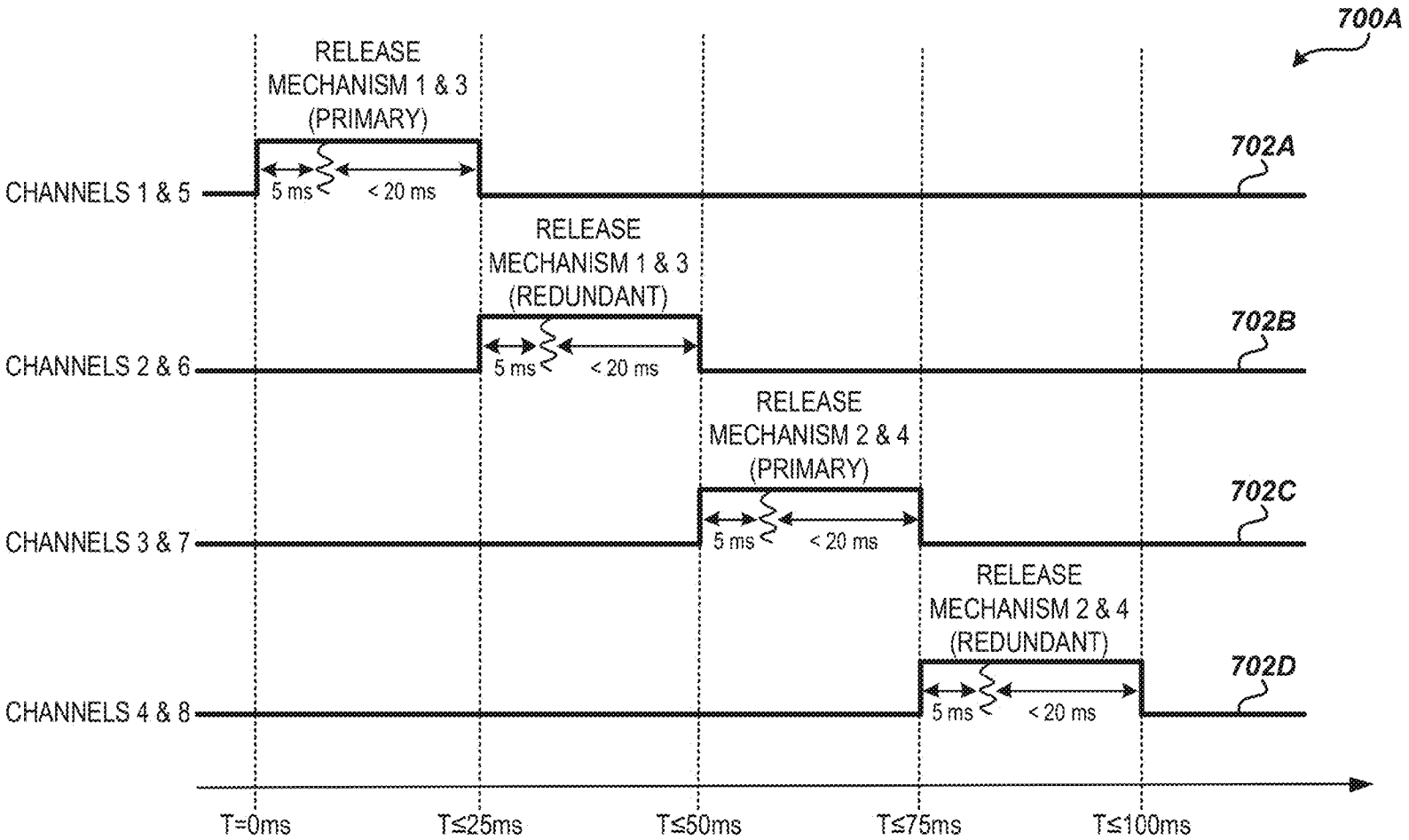
FIGS. 7A and 7B are timing diagrams showing exemplary squib initiation sequences implemented by the squib initiation sequencer, according embodiments presented herein.

FIG. 7A shows one example of a squib initiation sequence 700A that may be implemented by the squib initiation sequencer 102 for the deployment of the payload 106 from the ejector platform 104 shown in FIG. 1 above, according to one embodiment. As described above in regard to FIG. 3, each of the release mechanisms 108A-108D detachably-connecting the payload 106 to the ejector platform 104 may contain both a primary squib 306A and a redundant squib 306B.

The squib initiation sequencer 102 may be connected to the primary squib 306A and the redundant squib 306B of a particular release mechanism 108 through separate channels. For example, channel 1 of the squib initiation sequencer 102 may be connected to the primary squib 306A of release mechanism 108A, while channel 2 may be connected to the redundant squib 306B of release mechanism 108A. Similarly, channels 3 and 4 of the squib initiation sequencer 102 may be connected to the primary and redundant squibs, respectively, of release mechanism 108B, with channels 5 and 6 connected to the primary and redundant squibs, respectively, of release mechanism 108C, and channels 7 and 8 connected to the primary and redundant squibs, respectively, of release mechanism 108D, as shown in FIG. 3. Release mechanisms 108A-108D are referred to in FIGS. 7A and 7B as release mechanism 1 through release mechanism 4, respectively.

In the squib initiation sequence 700A shown in FIG. 7A, the logic module 402 of the squib initiation sequencer 102 first fires the primary squibs 306A of release mechanism 1 and release mechanism 3 connected to channels 1 and 5 of the sequencer, as indicated by line 702A. After a 5 millisecond minimum firing time, the logic module 402 monitors the firing monitor 420 of the firing circuits 412 corresponding to channels 1 and 5 in order to detect when firing of the connected squibs is complete. Upon detecting that both the primary squibs 306A of release mechanism 1 and release mechanism 3 have fired, or upon the expiration of the 25 millisecond maximum firing time for the squibs, the logic module 402 moves to the next step in the squib initiation sequence 700A and fires the redundant squibs 306B of release mechanism 1 and release mechanism 3 connected to channels 2 and 6 of the squib initiation sequencer 102, as indicated by line 702B. After firing the redundant squibs 306B of release mechanisms 1 and 3, the logic module 402 continues with the squib initiation sequence 700A by firing the primary squibs 306A of release mechanisms 2 and 4 connected to channels 3 and 7 of the squib initiation sequencer 102 and then the redundant squibs 306B of release mechanisms 2 and 4 connected to channels 4 and 8, as indicated by lines 702C and 702D in FIG. 7A.

It will be appreciated that if the primary squibs 306A and redundant squibs 306B of the release mechanisms 108A-108D require 3.5 amps of current for 25 milliseconds to ensure initiation according to manufacturer's specifications, firing the primary and redundant squibs of all four release mechanisms simultaneously would require 28 amps of current, which may be beyond the capabilities of the power supply 302 of the launch vehicle. Further, if all the squibs 306 in a sequence similar to that shown in FIG. 7A are fired for the maximum firing period of 25 milliseconds, the total time for the overall sequence would be 100 milliseconds. It will be further appreciated that the squib initiation sequencer 102 described herein may initiate the primary and redundant squibs 306 of the four release mechanisms 108A-108D using the squib initiation sequence 700A shown in FIG. 7A, thus requiring a maximum current of only 7 amps and a total time for the initiation of the squibs as low as 20 milliseconds.

Figure 7B:
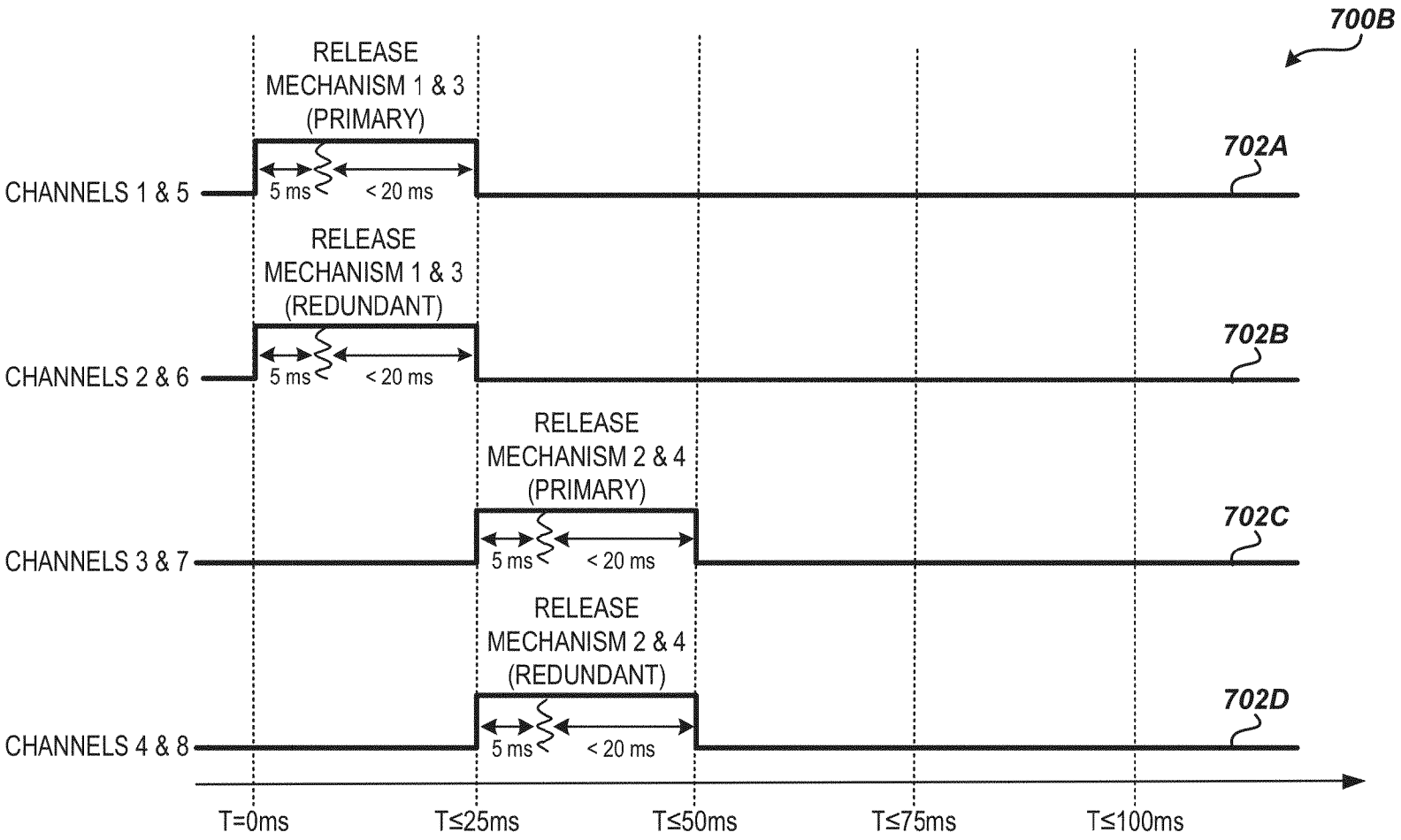

FIG. 7B shows another example of a squib initiation sequence 700B that may be implemented by the squib initiation sequencer 102, according to another embodiment. According to one embodiment, the squib initiation sequence 700B is pre-programmed in the squib initiation sequencer 102 as an alternative to the squib initiation sequence 700A described above. Upon receiving the initiation signal 410 from the guidance computer 304, the logic module 402 utilizes the pre-programmed squib initiation sequence 700B to fire the squibs 306. Alternatively, the guidance computer 304 may send additional bits or bytes in the initiation signal 410 that selects the squib initiation sequence 700B from among other sequences, such as squib initiation sequence 700A, stored in the memory of the squib initiation sequencer 102 for the initiation of the squibs.

In the squib initiation sequence 700B, the logic module 402 of the squib initiation sequencer 102 first fires the primary squibs 306A of release mechanism 1 and release mechanism 3 connected to channels 1 and 5 and the redundant squibs 306B of release mechanisms 1 and 3 connected to channels 2 and 6 of the sequencer at the same time, as indicated by lines 702A and 702B in FIG. 7B. After the 5 millisecond minimum firing time, the logic module 402 monitors the firing monitor 420 of the firing circuits 412 corresponding to channels 1, 2, 5, and 6 to detect when firing of all the connected squibs is complete. Upon detecting that both the primary and redundant squibs 306 of release mechanisms 1 and 2 have fired, or upon the expiration of the 25 millisecond maximum firing time for the squibs, the logic module 402 moves to the next step in the squib initiation sequence 700B and fires the primary squibs 306A and redundant squibs 306B of release mechanisms 2 and 4 connected to channels 3, 7, 4, and 8 at the same time, as indicated by lines 702C and 702D in FIG. 7B.

Utilizing the example described above in regard to FIG. 7A, the squib initiation sequencer 102 described herein initiates the primary and redundant squibs 306 of the four release mechanisms 108A-108D using the squib initiation sequence 700B shown in FIG. 7B with a maximum current requirement of 14 amps and a total time for the initiation of the squibs as low as 10 milliseconds. It will be appreciated that the squib initiation sequencer 102 may utilize any number of squib initiation sequences beyond those shown in FIGS. 7A and 7B and described herein, depending upon the number of release mechanisms 108 utilized in the system, the number of squibs 306 in each, the power capabilities of the launch vehicle, the manufacturers specifications for the squibs 306, the timing requirements for the payload deployment or staging operation, and the like. In addition, the squib initiation sequencer 102 may dynamically select a squib initiation sequence from among a number of pre-programmed squib initiation sequences stored in the memory of the sequencer depending on commands received in the initiation signal 410 from the guidance computer 304, the current status of the power supply 302, an error condition in the logic module 402 or other component of the sequencer, the detection of an over-current in one or more connected squibs, and/or other dynamic flight parameters and conditions.

Based on the foregoing, it should be appreciated that technologies for sequentially initiating squibs in one or more release mechanisms in order to reduce power requirements and delay between firing of successive squibs are provided herein. The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A method for sequentially initiating a plurality of squibs in one or more release mechanisms, the method comprising:

firing a first squib and a second squib of the plurality of squibs at the same time by passing a current generated by a power source through the first squib and the second squib;

in response to determining that the current through the first squib is below a minimum threshold amount, disconnecting the first squib from the power source; and in response to determining that the current through the first squib and a current through the second squib are both below the minimum threshold amount, firing a third squib of the plurality of squibs.

2. The method of claim 1, further comprising:

upon firing the first squib, waiting a minimum firing time before determining the current through the first squib is below the minimum threshold amount.

3. The method of claim 1, wherein firing the first squib is performed upon receiving an initiation signal from a guidance computer.

4. The method of claim 1, disconnecting the first squib from the power source comprises:

opening one or more switches along an electrical path connecting the first squib to the power source in response to determining that the current through the first squib is below the minimum threshold amount.

5. A method for sequentially initiating a plurality of squibs in one or more release mechanisms, the method comprising:

firing a first squib of the plurality of squibs by passing a current generated by a power source through the first squib;

in response to determining that the current through the first squib is below a minimum threshold amount, disconnecting the first squib from the power source;

determining if a time of firing of the first squib is greater than or equal to a maximum firing time; and upon determining that the time of firing of the first squib is greater than or equal to the maximum firing time, disconnecting the first squib from the power source and firing a second squib of the plurality of squibs.

6. The method of claim 5, wherein an order of firing the first squib and the second squib is determined based upon a pre-programmed squib initiation sequence.

7. A squib initiation sequencer for releasing a payload or staging a launch vehicle, the squib initiation sequencer comprising:

a logic module configured to fire a plurality of squibs in a pre-programmed sequence;

a plurality of firing circuits electrically connected to the logic module, wherein each of the plurality of firing circuits is electrically connected to at least one squib of the plurality of squibs; and a firing monitor in each of the plurality of firing circuits configured to:

determine that the at least one squib of the plurality of squibs connected to a firing circuit has been fired based upon determining that current flow generated by a power source through the at least one squib of the plurality of squibs is below a minimum threshold amount, and signal the logic module to disconnect the at least one squib from the power source and proceed to fire a next squib of the plurality of squibs in the pre-programmed sequence after determining that the current flow through the at least one squib of the plurality of squibs is below the minimum threshold amount, wherein the squib initiation sequencer is mounted to an ejection platform and firing the plurality of squibs releases the payload or stages of the launch vehicle.

8. The squib initiation sequencer of claim 7, wherein the logic module is configured to provide a high signal and a complementary low signal to each of the plurality of firing circuits to fire the at least one squib connected to the firing circuit.

9. The squib initiation sequencer of claim 8, wherein the high signal controls a high-side field-effect transistor ("FET") and the complementary low signal controls a low-side FET, and wherein the high-side FET and the low-side FET control a current flow through the at least one squib connected to the firing circuit.

10. The squib initiation sequencer of claim 7, wherein the firing monitor determines that the at least one squib connected to the firing circuit has been fired by detecting that current flow through the at least one squib has dropped below the minimum threshold amount.

11. The squib initiation sequencer of claim 7, wherein the logic module is further configured to wait at least a minimum firing time after firing the at least one squib before proceeding to the next squib in the pre-programmed sequence.

12. The squib initiation sequencer of claim 7, wherein the logic module is further configured to proceed to the next squib in the pre-programmed sequence after a maximum firing time without receiving the signal from the firing monitor indicating that the at least one squib connected to the firing circuit has been fired.

13. The squib initiation sequencer of claim 7, further comprising an over-current monitor in each of the plurality of firing circuits configured to determine that an excessive amount of current is flowing through the at least one squib connected to the firing circuit and to signal the logic module to stop current flow to the at least one squib.

14. The squib initiation sequencer of claim 7, further comprising a current limiter in each of the plurality of firing circuits configured to limit an amount of current that may flow through the at least one squib connected to the firing circuit.

15. The squib initiation sequencer of claim 7, wherein the logic module is further configured to fire the plurality of squibs in the pre-programmed sequence in response to a received initiation signal.

16. The squib initiation sequencer of claim 15, wherein the logic module is further configured to select the pre-programmed sequence from among a plurality of pre-programmed squib initiation sequences based on contents of the initiation signal.

17. A system for separating two removably attached components, the system comprising:

a plurality of release mechanisms attaching the components, wherein each of the plurality of release mechanisms comprises a squib; and a squib initiation sequencer electrically connected to each of the plurality of release mechanisms and configured to fire the squibs of the plurality of release mechanisms using current provided by a power source in a preprogrammed sequence, wherein the squib initiation sequencer is further configured to fire a next squib in the pre-programmed sequence after determining that a firing of a first squib in the preprogrammed sequence is complete by determining that current flow through the first squib is below a minimum threshold amount, wherein the squib initiation sequencer is further configured to disconnect the first squib from the current source in response to determining that current flow through the first squib is below the minimum threshold amount, and wherein firing the first and next squibs releases the attached components to deploy a payload or stages of a launch vehicle during flight.

18. The system of claim 17, wherein the squibs of at least two of the plurality of release mechanisms are fired at a same time in the pre-programmed sequence, and wherein the squib initiation sequencer is further configured to determine that a firing of all of the squibs of the at least two of the plurality of release mechanisms is complete before proceeding to the next squib in the pre-programmed sequence.

19. The system of claim 17, wherein the squib initiation sequencer is further configured to send a telemetry signal to a guidance computer indicating when the firing of each squib in the plurality of release mechanisms has been completed.

* * * * *